US005688063A

United States Patent [19]

Yu et al.

[11] Patent Number: 5,688,063

[45] Date of Patent: Nov. 18, 1997

[54] WRITING APPARATUS WITH MASSAGER MEANS

[76] Inventors: Kuo-Yao Yu, No. 3-3, Alley 12, Lane 11, Min-I Rd., Chung-He City, Taipei County; Jermo Lin, 2F, No. 180, Sec. 3, Jong Shiaw E. Rd., Taipei, both of Taiwan

[21] Appl. No.: 721,038

[22] Filed: Sep. 26, 1996

[51] Int. Cl.[6] ..... B43K 29/00

[52] U.S. Cl. ..... 401/195; 401/109; 601/72

[58] Field of Search ..... 401/195, 109; 601/72

[56] References Cited

U.S. PATENT DOCUMENTS

| | | | |
|---|---|---|---|
| 3,451,391 | 6/1969 | Tavel | 601/72 |
| 3,602,217 | 8/1971 | Felton | 601/72 |
| 5,208,987 | 5/1993 | Christen | 401/195 X |
| 5,244,299 | 9/1993 | Chu . | |
| 5,247,218 | 9/1993 | Sven . | |
| 5,433,642 | 7/1995 | Chia . | |

FOREIGN PATENT DOCUMENTS

| | | | |
|---|---|---|---|
| 672087 | 3/1994 | Japan | 401/195 |

*Primary Examiner*—Steven A. Bratlie
*Attorney, Agent, or Firm*—Bacon & Thomas

[57] ABSTRACT

A writing apparatus with massaging means, including an upper barrel, a bottom barrel, a refill, and a massaging unit, the massaging unit including a battery, a vibrating motor, a button switch, and a massager head, wherein the massaging unit is mounted inside the upper barrel; the massager head is mounted on the button switch and extending out of the upper barrel, the massager head triggering the button switch to turn the vibrating motor when it is pressed against a part of the body to be massaged; the button switch is mounted in a mounting device retained above the vibrating motor; the battery is disposed below the vibrating motor.

5 Claims, 2 Drawing Sheets

WRITING APPARATUS WITH MASSAGER MEANS

BACKGROUND OF THE INVENTION

The present invention relates to writing apparatus, and relates more specifically to a writing apparatus with massager means.

Various vibrating apparatus have been developed for use in massaging. Exemplars are seen in U.S. Pat. No. 5,247,218 entitled "Hand held vibrating instrument", U.S. Pat. No. 5,244,299 entitled "Apparatus used in writing and massaging alternatively", U.S. Pat. No. 5,433,642 entitled "Toy marking device with changing display", Chinese Pat. App. No. 84203831 entitled "Writing instrument for use in massaging", etc. The hand held vibrating instrument of U.S. Pat. No. 5,247,218 provides a vibrating brush. In the apparatus used in writing and massaging alternatively of U.S. Pat. No. 5,244,299 and the toy marking device with changing display of U.S. Pat. No. 5,433,642, the massaging means cannot be operated directly by pressing the massager head against the body to be massaged, and must be controlled by a switch. The vibrating effect of the writing instrument for use in massaging of Chinese Pat. App. No. 84203831 is poor.

SUMMARY OF THE INVENTION

It is one object of the present invention to provide a writing apparatus with massager means which provides a satisfactory massaging effect. It is another object of the present invention to provide a writing apparatus with massager means which automatically turns on the massager means when the massager head is directly pressed against the body to be massaged. It is still another object of the present invention to provide a writing apparatus with massager means which has a retractable refill.

According to one aspect of the present invention, the writing apparatus comprises an upper barrel, a bottom barrel, a refill, and a massaging unit, the massaging unit including a battery, a vibrating motor, a button switch, and a massager head, wherein the massaging unit is mounted inside the upper barrel; the massager head is mounted on the button switch and extending out of the upper barrel, the massager head triggering the button switch to turn the vibrating motor when it is pressed against a part of the body to be massaged; the button switch is mounted in a mounting device retained above the vibrating motor; the battery is disposed below the vibrating motor. According to another aspect of the present invention, the mounting device holds the vibrating motor on the inside and the button switch on the outside, so that vibrating waves can be directly transmitted from the vibrating motor to the massager head through the button switch. The mounting device can be a shell, which holds the vibrating motor on the inside, covered with a top cover, which holds the button switch outside the shell. Alternatively, the mounting device can be links adapted for transmitting vibrating waves from the vibrating motor to the button switch.

DETAILED DESCRIPTION OF THE PREFERRED EMBODIMENT

Figure 1:
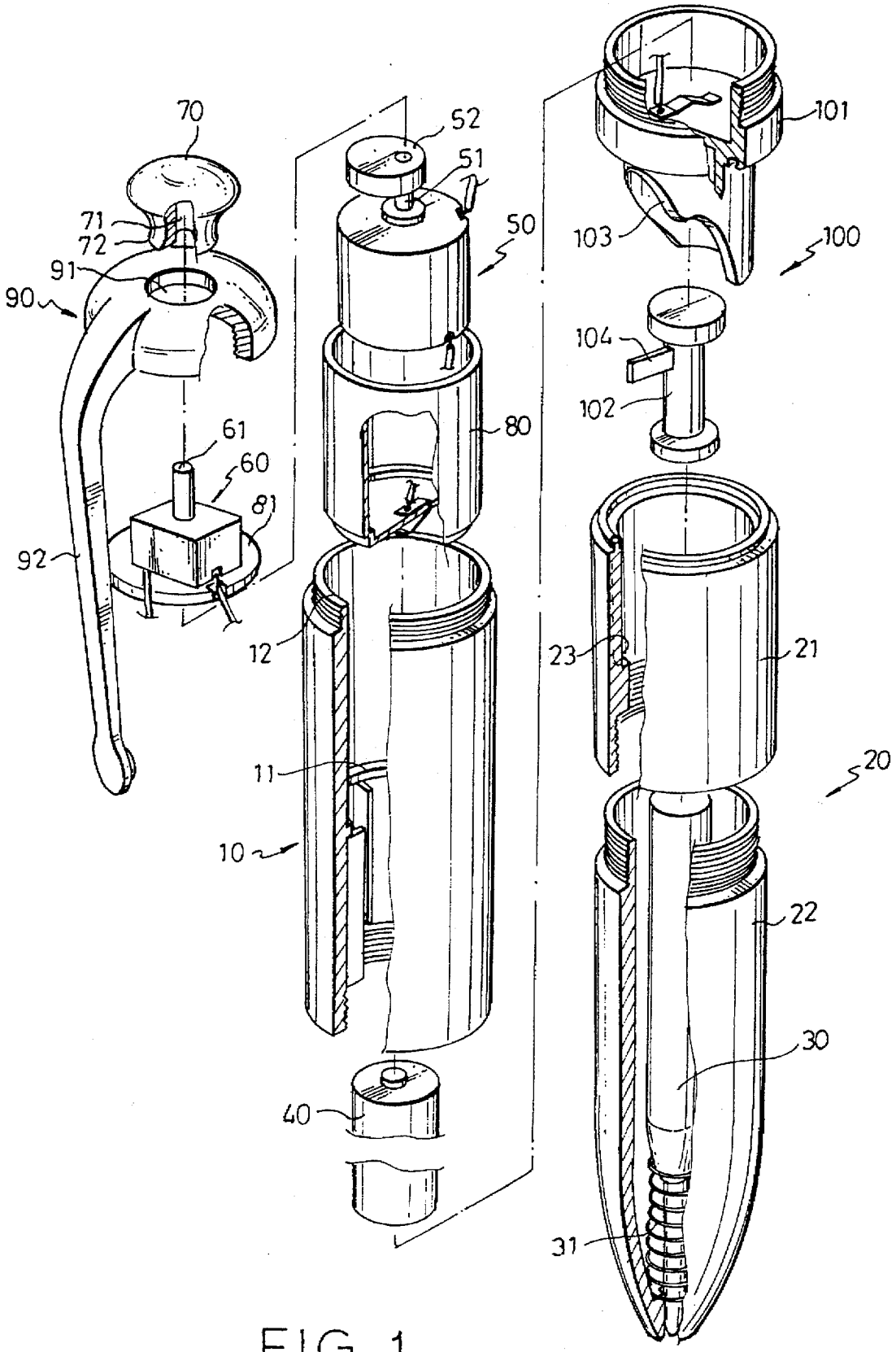
FIG. 1 is an exploded view of a writing apparatus with massager means according to the present invention.

Referring to FIG. 1, a writing apparatus with massager means in accordance with the present invention includes a writing unit, and a massaging unit. The writing unit is comprised of an upper barrel 10, a bottom barrel 20, and a refill 30. The massaging unit is comprised of a battery 40, a motor 50, a button switch 60, and massager head 70.

Figure 2:
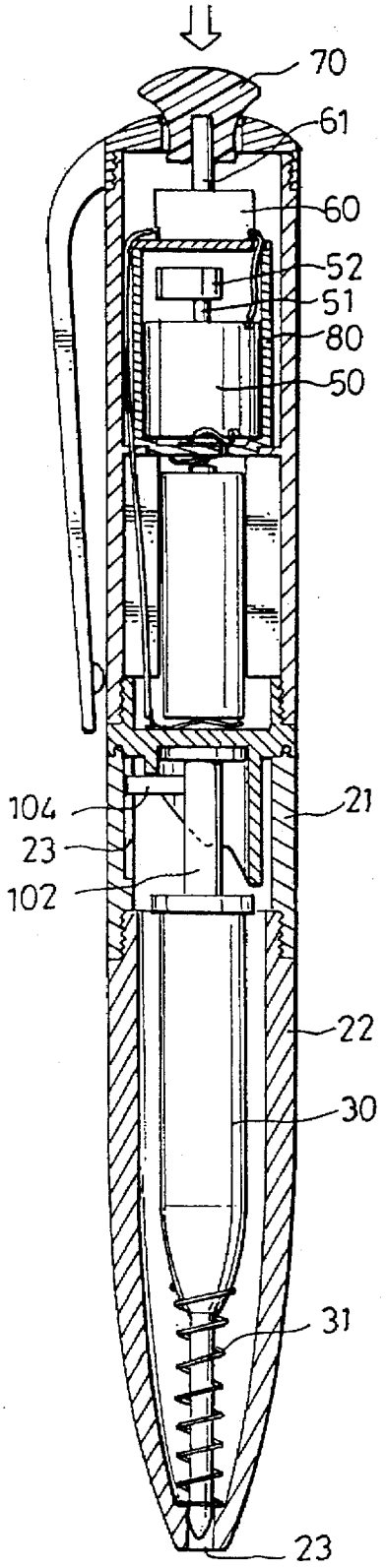
FIG. 2 is a sectional view of the present invention, showing the massaging unit started; and, FIG. 3 is a sectional elevation of the present invention, showing the point of the refill extended out of the bottom barrel.

Referring to FIG. 2 and FIG. 1 again, the motor 50 is mounted within a shell 80 inside the upper barrel 10, having an output shaft 51, and an eccentric wheel 52 fastened to the output shaft 51. The shell 80 is mounted within the upper barrel 10, supported on an inside annular flange 11 of the upper barrel 10, and covered with a top cover 81. The button switch 60 is mounted on the top cover 81 of the shell 80. The battery 40 is mounted within the upper barrel 10 below the shell 80, and electrically connected to the motor 50 through the button switch 60 by conductors. The massager head 70 has a bottom rod 72 defining a bottom coupling hole 71. The bottom coupling hole 71 of the massager head 70 is coupled to the press button 61 of the button switch 60. A pen cap 90 is fastened to the top opening 12 of the upper barrel 10 by a screw joint, having a through hole 91 through which the bottom rod 72 of the massager head 70 passes, and a clip 92 for fastening. The bottom barrel 20 is comprised of a first barrel section 21 and a second barrel section 22 fastened together by a screw joint. The detachable two-section design of the bottom barrel 20 facilitates the installation of the refill 30. The refill 30 is supported on a spring 31, and connected to an actuating mechanism 100. The actuating mechanism 100 comprises a rotary tube 101, and a propelling rod 102. The rotary tube 101 is fastened to the bottom end of the upper barrel 10 by a screw joint, having a bevel guide 103. The propelling rod 102 has a transverse rod 104 perpendicularly raised from the periphery, disposed in contact with the bevel guide 103, and forced by the bevel guide 103 to move along a track 23 in the first barrel section 21 of the bottom barrel 20. When the rotary tube 101 is turned, the transverse rod 104 of the propelling rod 102 is forced to move along the track 23, and therefore the refill 30 is moved vertically.

Referring to FIG. 2 again, when the massager head 70 is pressed against a part of the body, the button switch 60 is switched on, thereby causing the motor 50 to turn the eccentric wheel 52. When the eccentric wheel 52 is rotated, vibrating waves are directly transmitted through the shell 80 and the button switch 60 to the massager head 70, and fully acted on the body.

Figure 3:
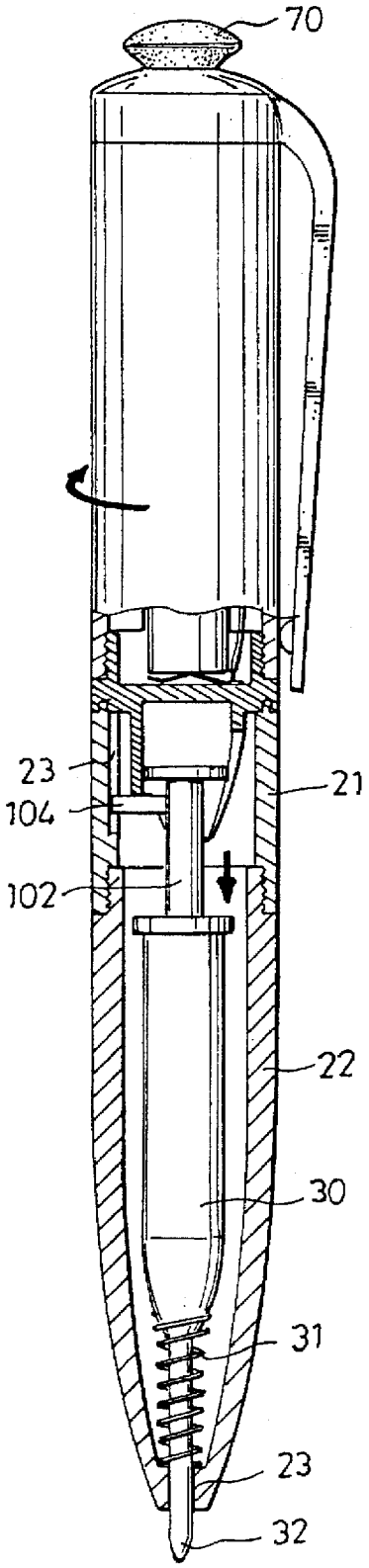

Referring to FIG. 3, when the upper barrel 10 is turned in one direction relative to the bottom barrel 20, the rotary tube 101 is simultaneously turned with the upper barrel 10, causing the transverse rod 104 of the propelling rod 102 to be moved downwards along the track 23 and the spring 31 to be compressed, and therefore the point 32 of the refill 30 is forced out of the bottom end 23 of the second barrel section 22 of the bottom barrel 20 for writing. On the contrary, when the upper barrel 10 is turned in the reversed direction, the spring 31 is released, and the point 32 of the refill 30 is received in the second barrel section 22 of the bottom barrel 20 again.

While only one embodiment of the present invention has been shown and described, it will be understood that various modifications and changes could be made thereunto without departing from the spirit and scope of the invention disclosed.

What the invention claimed is:

1. A writing apparatus with massaging means, comprising an upper barrel, a bottom barrel, a refill, and a massaging unit, said massaging unit comprising a battery, a vibrating motor, a button switch, and a massager head, wherein said massaging unit is mounted inside said upper barrel; said massager head is mounted on said button switch and extending out of said upper barrel, the massager head triggering said button switch to turn on said vibrating motor when it is pressed against a part of the body to be massaged; said button switch is mounted in a mounting device retained above said vibrating motor; said battery is disposed below said vibrating motor.

2. The writing apparatus of claim 1 wherein said upper barrel comprises a top opening through which said massager head passes to the outside, and an inside annular flange on which said vibrating motor is supported.

3. The writing apparatus of claim 1 wherein said mounting device is a shell covered with a top cover, said shell holding said vibrating motor on the inside, said top cover holding said button switch above said shell.

4. The writing apparatus of claim 1 wherein said massager head has a bottom coupling hole; said button switch has a switching control button coupled to the bottom coupling hole of said massager head.

5. The writing apparatus of claim 1 wherein said refill is supported on a spring and connected to an actuating mechanism, said actuating mechanism comprising a rotary tube and a propelling rod, said propelling rod being driven to move said refill vertically when said rotary tube is turned.

* * * * *